US007817111B2

(12) United States Patent
Park et al.

(10) Patent No.: US 7,817,111 B2
(45) Date of Patent: Oct. 19, 2010

(54) PLASMA DISPLAY DEVICE

(75) Inventors: Jong-Ho Park, Suwon-si (KR); Kyung-Won Kang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 868 days.

(21) Appl. No.: 11/713,633

(22) Filed: Mar. 5, 2007

(65) Prior Publication Data

US 2007/0257862 A1 Nov. 8, 2007

(30) Foreign Application Priority Data

Mar. 28, 2006 (KR) ..... 10-2006-0028073

(51) Int. Cl.
*G09G 3/28* (2006.01)
*G09G 3/10* (2006.01)
*H01J 17/49* (2006.01)

(52) U.S. Cl. ..... 345/60

(58) Field of Classification Search ..... 345/60; 315/169.4; 313/583
See application file for complete search history.

(56) References Cited

U.S. PATENT DOCUMENTS 6,428,345 B2 * 8/2002 Sawayanagi et al. ..... 439/456
7,140,896 B2 * 11/2006 Takai et al. ..... 439/260
2005/0286228 A1 * 12/2005 Kim ..... 361/704
2006/0141852 A1 * 6/2006 Sato et al. ..... 439/492
2007/0105423 A1 * 5/2007 Gillespie et al. ..... 439/260
2008/0311785 A1 * 12/2008 Hyun et al. ..... 439/372

FOREIGN PATENT DOCUMENTS

KR 10-2005-0035726 4/2005

* cited by examiner

*Primary Examiner*—Evan Pert
(74) *Attorney, Agent, or Firm*—Lee & Morse, P.C.

(57) ABSTRACT

A plasma display device may include a plasma display panel, a chassis arranged on one side of the plasma display panel, the chassis supporting the plasma display panel, a plurality of circuit units arranged on one surface of the chassis, the circuit units generating electrical signals that are used to drive the plasma display panel, a signal transmission member linking the circuit units to each other and to the plasma display panel so as to transmit the electrical signals, a coupling member installed on at least one of the circuit units, coupling the signal transmission member to at least one of the circuit units, and a foreign material blocking member installed on at least one of the circuit units, preventing a foreign material from intruding into the coupling member.

16 Claims, 7 Drawing Sheets

PLASMA DISPLAY DEVICE

BACKGROUND OF THE INVENTION

1. Field of the Invention

The present invention relates to a plasma display device, and more particularly, to a plasma display device including a foreign material blocking member.

2. Description of the Related Art

Plasma display devices are flat display devices that display an image using a gas discharge phenomenon. Plasma display devices may provide large screens with a number of desirable traits, e.g., a high-quality image display, a very thin and light design, and a wide-range viewing angle. In addition, these displays may be manufactured in a simplified manner, when compared with other flat display panels. Accordingly, plasma display devices have attracted considerable attention as the most promising next-generation flat display devices.

Such plasma display devices include a plasma display panel (PDP) that displays an image by exciting a phosphor material with ultraviolet rays generated during gas discharge. PDPs may be classified into types according to the discharge voltage applied to the discharge cells, e.g., a direct current (DC) type, an alternating current (AC) type, and a hybrid type. PDPs may also be classified into a facing discharge type and a surface discharge type according to the type of discharge structure used.

Facing discharge PDPs have a problem in that their life spans may be reduced due to a degradation of a phosphor material caused by ions generated during discharge. On the other hand, surface discharge PDPs minimize the degradation of a phosphor material by collecting discharge on a side opposite to a side on which the phosphor material is formed, whereby the problems of the structure of facing discharge PDPs may be minimized. Hence, surface discharge PDPs are widely used at present.

Plasma display devices may include a PDP which displays an image, a chassis that supports the PDP, and a number of circuit units that process electrical signals used to drive the PDP. A signal transmission member, e.g., a tape carrier package (TCP) or a flexible flat cable (FFC), may connect the circuit units to each other or may connect each of the circuit units to input electrodes on the PDP to drive the display.

One end of the signal transmission member may be connected to a circuit unit by a connector which may be a coupling member. The connector may be mounted on a circuit board together with other circuit elements during mass-production of the circuit units. However, the connector may include conductive metal pins that electrically contact the pins of the signal transmission member. The pins of the connector may be partially exposed even after the connector is installed in a circuit unit. When an external foreign substance contacts the exposed pins, an electrical signal being transmitted by the signal transmission member may be mixed with noise, leading to erroneous image displays.

To prevent this problem, in the conventional art, the exposed pins may be covered with silicone after a connector is mounted on a circuit unit.

However, this process increases the production lead time of a circuit unit by the amount of time required to dry the silicone, and there may be difficulty in controlling the amount of silicone to be used. Hence, the silicone may intrude up to the connector's actuator. The actuator may be rotated to couple the signal transmission member to the connector. The silicone may compromise the connection between the connector and the signal transmission member.

In addition, when the pins of an assembled connector may become short-circuited, the silicone coating may need to be reapplied. However, once silicone is applied, it may be very difficult to completely remove the silicone. Efforts to remove the silicone may increase the probability of secondary damage, e.g., destruction of a printed circuit board (PCB).

Further, the actuator of the conventional plasma display device may be opened excessively, which may damage the connector.

SUMMARY OF THE INVENTION

The present invention is therefore directed to a plasma display device having a foreign material blocking member, which substantially overcomes one or more of the problems due to the limitations and disadvantages of the related art.

It is therefore a feature of an embodiment of the present invention to provide a foreign material blocking member for a circuit coupling member that may prevent the compromise of the circuit coupling from foreign material.

It is therefore another feature of an embodiment of the present invention to provide an actuator limiter that may prevent the actuator from excessive movement and thereby prevent damage to the actuator.

At least one of the above and other features and advantages of the present invention may be realized by providing a plasma display device including a plasma display panel, a chassis on one side of the plasma display panel, supporting the plasma display panel, a plurality of circuit units arranged on one surface of the chassis, generating electrical signals to drive the plasma display panel, a signal transmission member connecting the circuit units to each other and to the plasma display panel so as to transmit the electrical signals, a coupling member on at least one of the circuit units, coupling the signal transmission member to at least one of the circuit units, and a foreign material blocking member on the at least one of the circuit units, preventing a foreign material from intruding into the coupling member.

In some embodiments, the signal transmission member may be at least one member of the group consisting of a flexible flat cable (FFC) and a tape carrier package (TCP).

In some embodiments, the foreign material blocking member may include a plurality of mounting bosses, wherein each mounting boss may include a relief slot to enable quick attachment to and removal from the circuit unit.

In some embodiments, an end of each of the bosses may include a member having a vertical cross-section in the shape of an arrowhead whose outer circumference increases from a bottom end to a top end of the arrowhead.

In other embodiments, the foreign material blocking member may include a shield that encloses an exposed pin coupling portion of the coupling member.

In other embodiments, the circuit unit includes holes through which at least one boss of the foreign material blocking member may be coupled to the circuit unit.

In other embodiments, the coupling member may include a fixed coupler fixed to the circuit unit, and an actuator rotatably attached to the coupling member to couple the signal transmission member to the coupling member.

In other embodiments, the foreign material blocking member may include an actuator limiter that limits rotation of the actuator.

In still other embodiments, the actuator limiter may define the rotation range for the actuator.

In still other embodiments, the fixed coupler may include a protruding tab and the foreign material blocking member may include a groove, wherein the protruding tab engages the groove when the fixed coupler and the block may be fully engaged.

In even other embodiments, the protruding tab may be formed on at least one of a pair of side surfaces and a rear surface of the fixed coupler, and the groove on the foreign material blocking member may be disposed to engage the protruding tab.

In yet other embodiments, the plasma display device may include a horizontal coupling surface integral with the foreign material blocking member, and slanted engagement ramps disposed on the foreign material blocking member and the fixed coupler perpendicular to the horizontal coupling surface.

In even other embodiments, the plasma display device may include a vertical coupling surface integral with the foreign material blocking member and slanted engagement ramps disposed on the foreign material blocking member and the fixed coupler perpendicular to the vertical coupling surface.

According to the present invention, foreign material may be prevented from compromising electrical connections of a plasma display device.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Korean Patent Application No. 10-2006-0028073, filed on Mar. 28, 2006, in the Korean Intellectual Property Office, and entitled: "Plasma Display Device," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

The present invention will now be described more fully with reference to the accompanying drawings, in which exemplary embodiments of the invention are shown.

Figure 1:
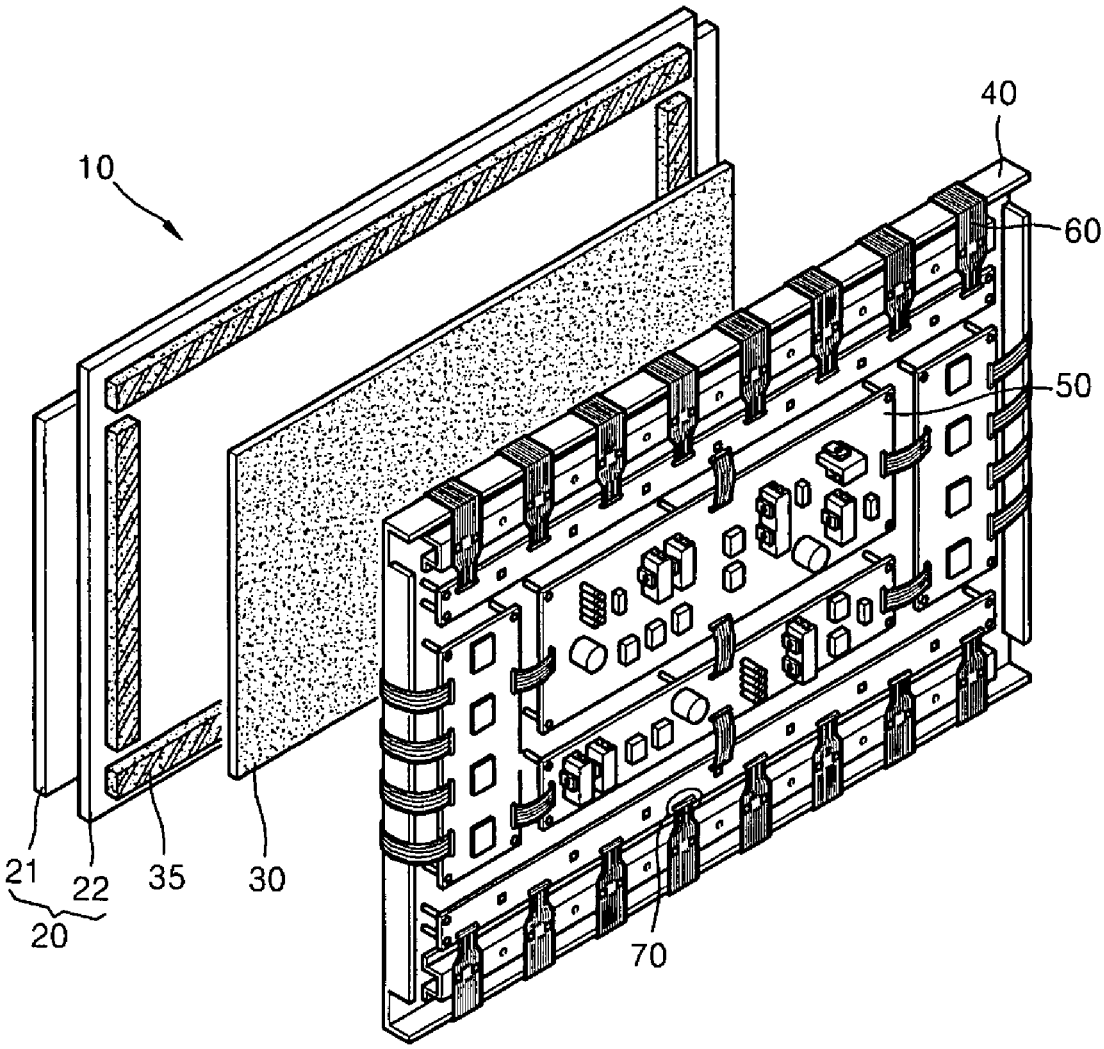
FIG. 1 illustrates an exploded perspective view of a plasma display device according to an embodiment of the present invention.

FIG. 1 illustrates an exploded perspective view of a plasma display device 10 according to an embodiment of the present invention. Referring to FIG. 1, the plasma display device 10 may include a plasma display panel (PDP) 20 and a chassis base 40.

The PDP 20 may include a plurality of electrodes 222, 223 (see FIG. 2) formed between two facing substrates 21 and 22. A discharge gas may be injected between the front panel 21 and the rear panel 22, and then a discharge voltage may be applied to the discharge gas. A phosphor material in the PDP 20 may be excited by ultraviolet (UV) light generated from the discharge gas and voltage in a predetermined pattern, so that a desired image may be displayed. The PDP 20 will be described in greater detail later with reference to FIG. 2.

The PDP 20 may be supported by the chassis base 40 located at the rear of the PDP 20. The PDP 20 and the chassis base 40 may be coupled together by double-sided tape 35. The PDP 20 may generate a lot of heat due to the discharge phenomenon described above, so a thermal sheet 30 formed of a thermally conductive material may be interposed between the chassis base 40 and the PDP 20 to conduct heat from the PDP 20 to the chassis base 40.

Circuit units 50 may be connected to the electrodes of the PDP 20, and may be installed on the back of the chassis base 40. The electrodes of the PDP 20 may be connected to the circuit units 50 by a signal transmission member 60, e.g., a tape carrier package (TCP). The circuit units 50 may also be connected to each other by the signal transmission members 60.

The signal transmission member 60 and the circuit units 50 may be connected to each other by a coupling member 310, e.g., a connector. A foreign material blocking member 330 may be arranged on the circuit units 50 to prevent external foreign materials from entering into the coupling member 310. The combined coupling member 310 and foreign material blocking member 330 are indicated as element 70, which will be described in greater detail with reference to FIGS. 3 through 7.

Figure 2:
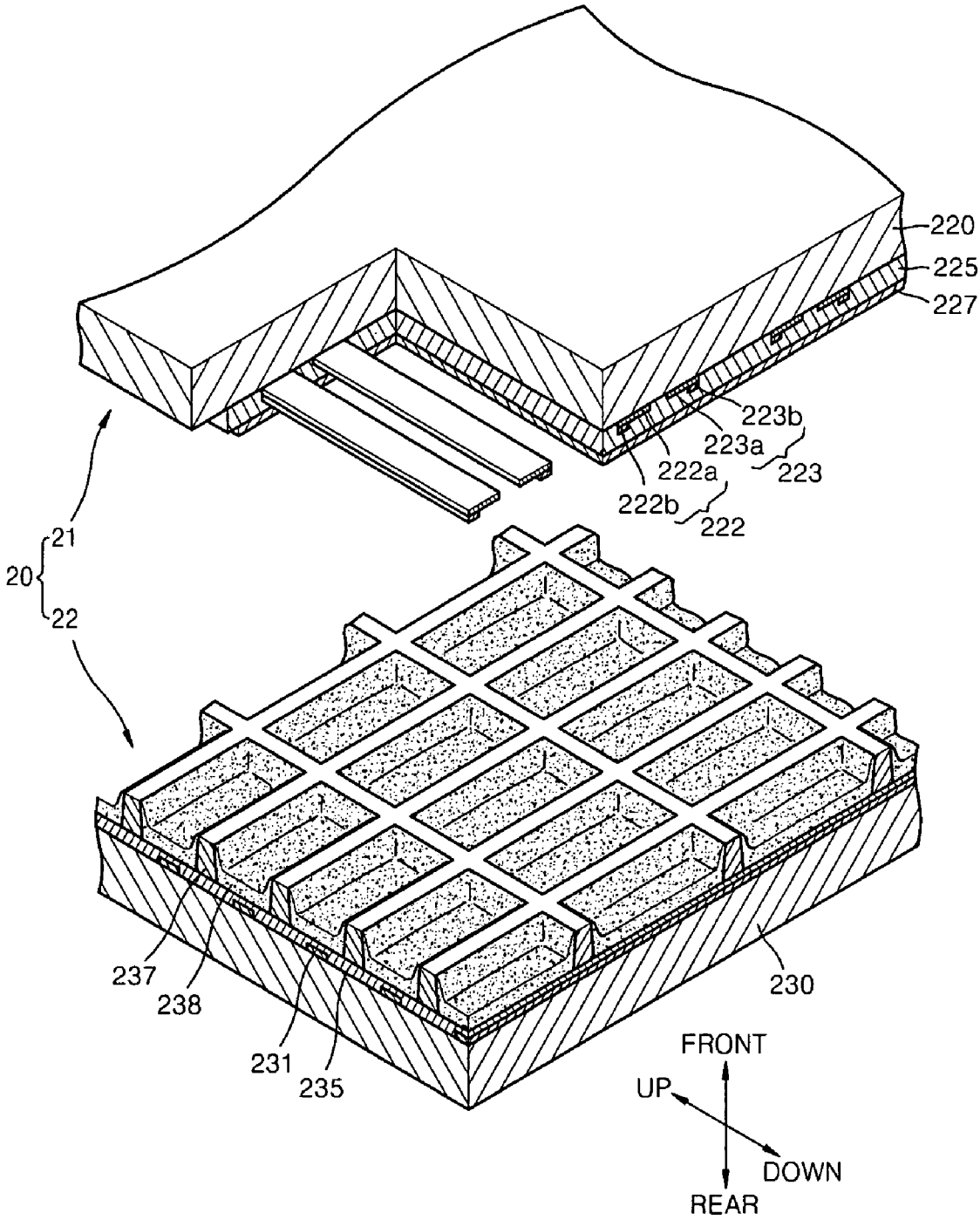
FIG. 2 illustrates an exploded perspective view of a plasma display panel according to the plasma display device of FIG. 1.

FIG. 2 illustrates an exploded perspective view of a 3-electrode surface discharge PDP as an exemplary embodiment of the PDP 20. The 3-electrode surface discharge PDP 20 illustrated in FIG. 2 may be a component of the plasma display device 10 according to FIG. 1. Of course, other types of PDPs may be used, e.g., an opposite discharge PDP, a PDP including electrodes formed within a barrier structure, a PDP having a delta type electrode structure, or a PDP having no indium-tin-oxide (ITO) electrodes. Accordingly, the PDP 20 illustrated in FIG. 2 is simply one possible component that may be included in a plasma display device 10 according to an embodiment, and does not restrict the scope of the present invention.

Referring to FIG. 2, the PDP 20 may be manufactured by combining a front panel 21 and a rear panel 22.

The front panel 21 may include a front substrate 220 with pairs of sustain discharge electrodes 222, 223 arranged on the lower surface of the front substrate 220. A first dielectric layer 225 may cover the sustain discharge electrodes 222, 223, and a protection film 227 may cover the first dielectric layer 225. Each pair of the sustain discharge electrodes may include an X electrode 222 and a Y electrode 223. The X electrode 222 may include a transparent electrode **222*a*** and a bus electrode 222*b*, and the Y electrode 223 may include a transparent electrode 223*a* and a bus electrode 223*b*.

The rear panel 22 may include a rear substrate 230, address electrodes 231 arranged parallel to each other on the upper surface of the rear substrate 230, a second dielectric layer 235 covering the address electrodes 231, a barrier structure 237 formed on the second dielectric layer 235, and phosphor layers 238 formed on exposed portions of the upper surface of the second dielectric layer 235 and sidewalls of the barrier structure 237.

The front and rear substrates 220 and 230 may be formed of soda-lime glass having good visible light transmissivity and may also be colored or tinted in order to improve bright room contrast. Alternatively, the front and rear substrates 220 and 230 may be formed of plastic so as to be flexible.

The X and Y electrodes 222 and 223 formed on one surface of the front substrate 220 may include transparent electrodes 222*a* and 223*a*, respectively, and bus electrodes 222*b* and 223*b*, respectively. The transparent electrodes 222*a* and 223*a* may be formed of a material that may be electrically conductive to generate discharge, but transparent so as not to disturb the propagation of light emitted from the phosphor layers 238 toward the front substrate 220. Transparent conductive materials include, e.g., indium tin oxide (ITO) and antimony tin oxide (ATO).

The transparent conductive material, e.g., ITO, may have great resistance, so that if a sustain discharge electrode includes only a transparent electrode 222*a*, 223*a*, there may be a large voltage drop in the direction of the sustain discharge electrode. Thus, a lot of driving power may be consumed, and the response speed may be decreased. To overcome these problems, the sustain discharge electrodes may include bus electrodes 222*b*, 223*b* arranged on the transparent electrodes 222*a*, 223*a*. The bus electrodes 222*b*, 223*b* may be formed of a metal and may be relatively narrow as compared to the transparent electrodes 222*a*, 223*a*.

The first dielectric layer 225 may be formed on the front substrate 220 so as to envelope the X electrodes 222 and the Y electrodes 223 in the first dielectric layer 225. The first dielectric layer 225 may be formed of a dielectric material, e.g., PbO, $B_2O_3$, $SiO_2$, capable of inducing charges and accumulating wall charges, in order to prevent electricity from directly flowing between adjacent X electrodes 222 and Y electrodes 223 during discharge, and to prevent the X electrodes 222 and Y electrodes 223 from being damaged due to direct collisions with positive ions or electrons.

The first dielectric layer 225 may be protected by the protection film 227. The protection film 227, e.g., magnesium oxide (MgO) or magnesium fluoride ($MgF_2$), may protect the first dielectric layer 225 by preventing the dielectric material from being sputtered due to ion bombardment.

The address electrodes 231 may be arranged on the rear substrate 230 so as to intersect the sustain discharge electrodes 222 and 223. The address electrodes 231 may provoke address discharge to facilitate sustained discharge between the X and Y electrodes 222 and 223. More specifically, the address electrodes 231 may lower the voltage used to provoke sustained discharge. The address electrodes 231 may be arranged in a stripe pattern to intersect the sustain discharge electrodes.

The address electrodes 231 may be covered with the second dielectric layer 235. The second dielectric layer 235, e.g., PbO, $B_2O_3$, $SiO_2$, may prevent the address electrodes 231 from being damaged due to direct collisions with positive ions or electrons during discharge. The second dielectric layer 235 may include, or be integrally formed with, a reflection film to prevent visible light generated within the discharge cells from exiting the rear of the PDP 20.

The barrier structure 237 may define the discharge cells and may be installed on the second dielectric layer 235. Although the barrier structure 237 illustrated in FIG. 2 defines rectangular discharge cells arranged in a matrix, the present invention is not limited to this structure of the discharge cells. The discharge cells may have the other shapes, e.g., a stripe shape, a circular shape, or a delta shape. Adjacent discharge cells may be separated by the barrier structure 237. The barrier structure 237 may define unit pixels that form an image. The barrier structure 237 may prevent color mixture between pixels by preventing crosstalk where discharge may be mixed on an interface between discharge cells. The barrier structure 237 may define the spaces, which may be coated with phosphor 238, and therefore where discharge occurs. The size of such each discharge space may be determined by the size and configuration of the ribs of the barrier 237. The size of a discharge space may depend on the width of an upper surface of a barrier rib or the distance between adjacent barrier ribs.

Red, green, and blue phosphor layers 238 may be formed on exposed portions of the upper surface of the second dielectric layer 235 and sidewalls of the barrier structure 237. The phosphor layers 238 may include a component that generates visible light in response to UV light. The red phosphor layers 238, e.g., $Y(V,P)O_4$:Eu, may be formed in red discharge cells, the green phosphor layers 238, e.g. $Zn_2SiO_4$:Mn, may be formed in green discharge cells, and the blue phosphor layers 238, e.g., BaM:Eu, may be formed in blue discharge cells.

The discharge cells may be filled with a discharge gas that may be excited or provoke discharge when a voltage may be applied to the electrodes 222, 223, and 231 within the discharge cells. The discharge gas, e.g., at least one of argon (Ar), xenon (Xe), nitrogen ($N_2$), heavy hydrogen ($D_2$), carbon dioxide ($CO_2$), hydrogen ($H_2$), carbon monoxide (CO), krypton (Kr) or air, may be excited by external energy, e.g., electron beams, to generate UV light, or serve as a discharge gas.

The foreign material blocking member and surrounding structure, corresponding to an exemplary embodiment of a plasma display device according to the present invention, will now be described with reference to FIGS. 3 through 7.

Figure 3:
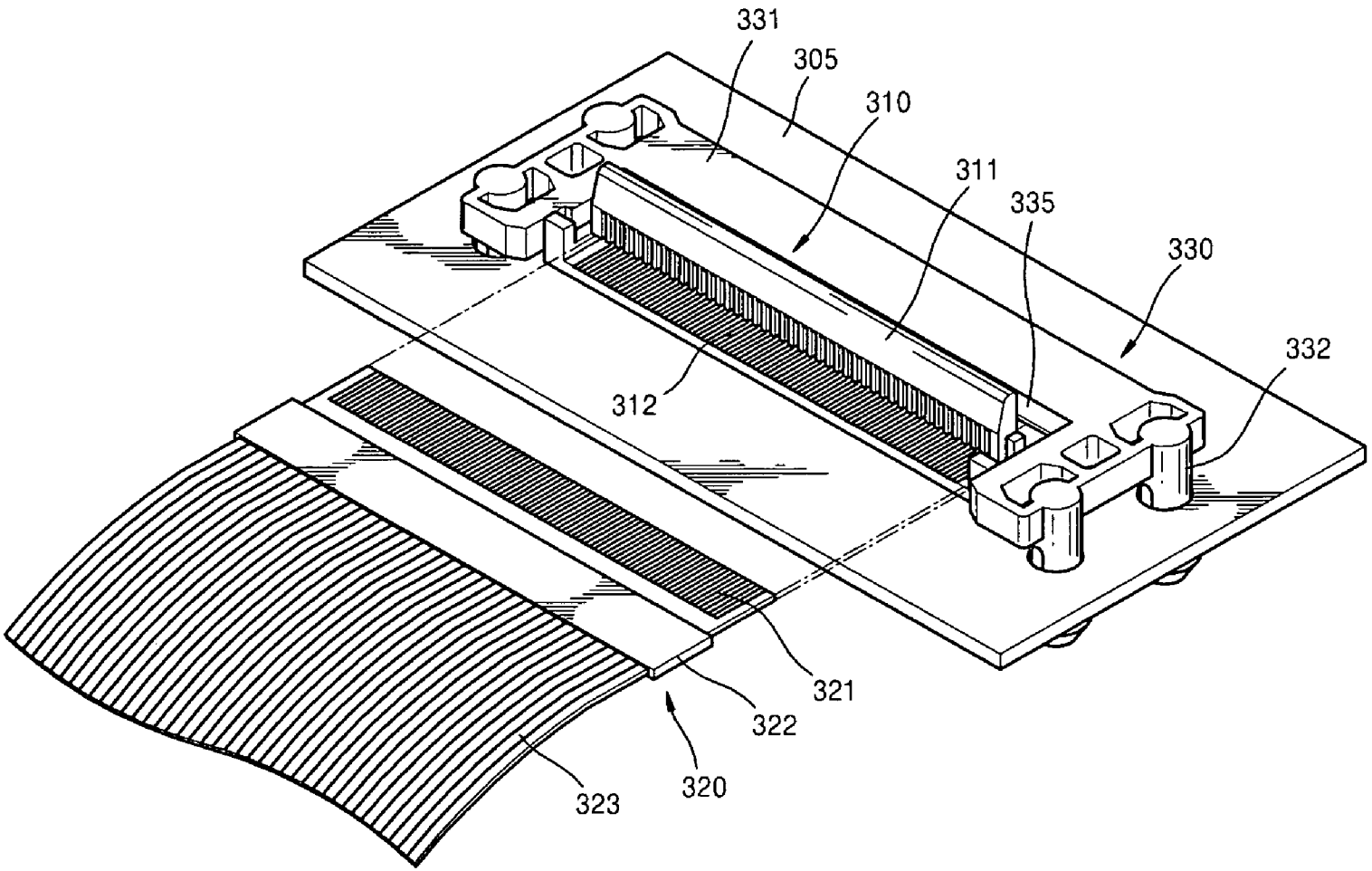
FIGS. 3 and 4 illustrate perspective views of a coupling member, a signal transmission member, and a foreign substance preventing member according to the plasma display device of FIG. 1.
Figure 4:
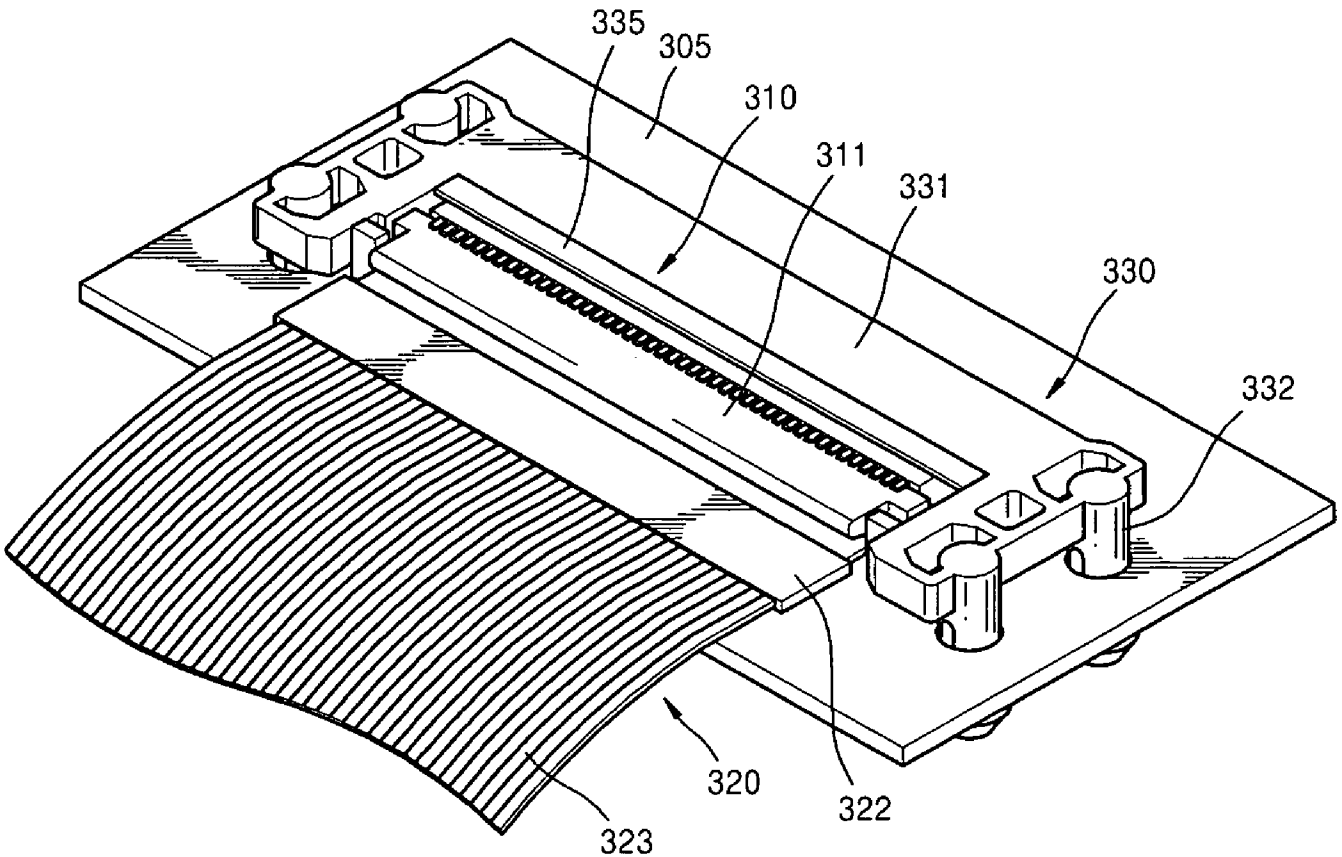
Figure 5:
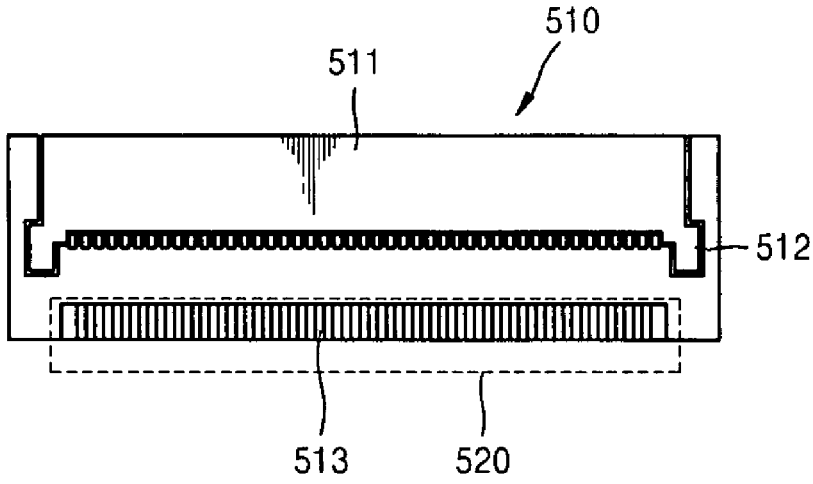
FIG. 5 illustrates a plan view of a coupling member according to the plasma display device of FIG. 1.
Figure 6:
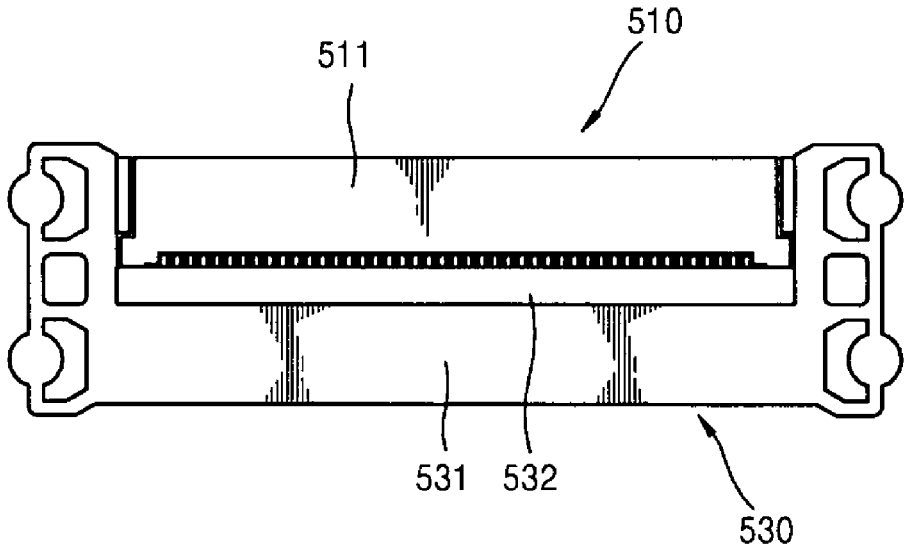
FIG. 6 illustrates a plan view of the coupling member of FIG. 5 according to an embodiment of the present invention.
Figure 7:
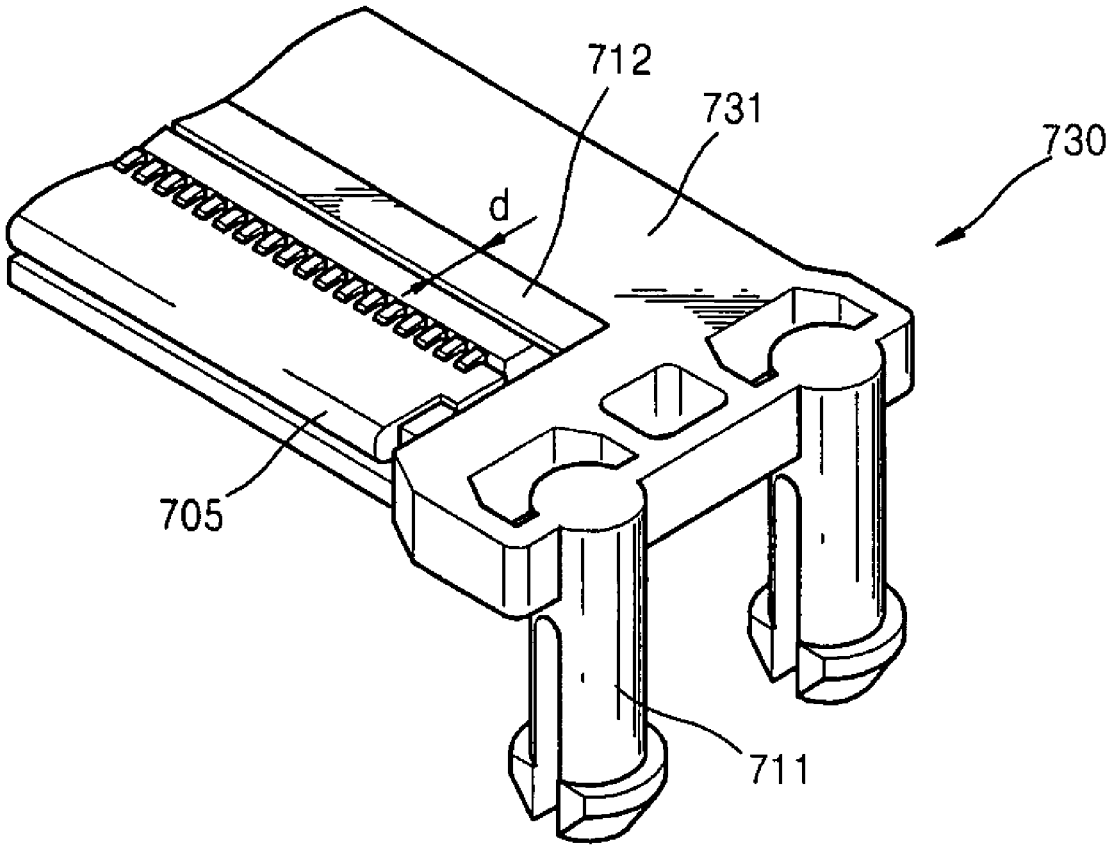
FIG. 7 illustrates a perspective view of an interface between the coupling member and a block member according to an embodiment of the present invention.

FIGS. 3 through 7 illustrate magnified views of the foreign material blocking member and coupling member 70 and the surrounding structure. FIG. 3 illustrates the signal transmission member and the coupling member in an uncoupled state. FIG. 4 illustrates the coupled signal transmission member and the coupling member. FIG. 5 illustrates a plan view of a coupling member without a foreign material blocking member. FIG. 6 illustrates a plan view of the coupling member of FIG. 5 with a foreign material blocking member coupled. FIG. 7 illustrates a perspective view of an interface between the coupling member and the foreign material blocking member.

Referring to FIGS. 3 and 4, a coupling member 310 and a foreign material blocking member 330 may be arranged on a circuit board 305. The circuit board 305 may be one of the circuit units 50 shown in FIG. 1.

A signal transmission member 320 may include a flexible cable 323, a conductive pin set 321 which may be coupled to the coupling member 310, and a coupling array 322 between the cable part 323 and the pin set 321. The signal transmission member 320 may be a TCP or a flexible flat cable (FFC). Hence, an integrated circuit (not shown) may be mounted on the flexible cable 323.

The conductive pin set 321 may be connected to the coupling member 310, which may mate with the pin set 321 to receive an electric signal. FIG. 3 illustrates the signal transmission member 320 in a position where it is not coupled to the coupling member 310. FIG. 4 illustrates the signal transmission member 320 coupled to the coupling member 310. In FIGS. 3 and 4, like reference numerals indicate like members.

The coupling member 310 may include a fixed coupler 312 and an actuator 311. The fixed coupler 312 may be a stationary part attached to the circuit board 305. The fixed coupler 312 may be electrically connected to the pin set 321 of the signal transmission member 320 to receive a signal through the signal transmission member 320. The fixed coupler 312 may be formed of a conductive material, e.g., silver, copper, and may be electrically connected to the pin set 321 at the pin coupling. The pin coupling may enable electrical communication through the circuit board 305 to various circuit elements (not shown) mounted on the circuit board 305. To achieve this electrical connection, the pin coupling may extend into the coupling member 310 that may be surrounded by the foreign material blocking member 330. When the foreign material blocking member 330 is not installed, the pin coupling may be entirely or partially exposed to the outside.

The actuator 311 may be hingedly attached to the coupling member 310 and the fixed coupler 312 to releasably attach the signal transmission member 320 to the coupling member 310. FIG. 3 illustrates the actuator 311 in an open position. FIG. 4 illustrates the signal transmission member 320 coupled to the coupling member 310 with the actuator 311 in a closed position. When the actuator 311 is closed, the signal transmission member 320 and the coupling member 310 may be firmly engaged with each other. The actuator 311 may be opened to separate the signal transmission member 320 from the coupling member 310. If the actuator 311 is rotated beyond a predetermined limit, the coupling member 310 may be damaged. To prevent this damage, the foreign material blocking member 330 may include an actuator limiter 335 that prevents excessive rotation of the actuator 311.

In an exemplary embodiment, the foreign material blocking member 330 may have a "⊏"shape to surround the coupling member 310. Of course, the present invention is not limited to this shape. The foreign material blocking member 330 may have about any other shape that may be capable of protecting the pin coupling between the signal transmission member 320 and the coupling member 310. The foreign material blocking member 330 may include a shield 331 large enough to cover the pin coupling portion, to protect the exposed pin coupling portion of the coupling member 310. The shield 331 may have the configuration illustrated in FIG. 3 or any other configuration that may protect at least the pin coupling and prevent the intrusion of a foreign material. The foreign material blocking member 330 may be coupled to the circuit board 305 by four bosses 332.

FIGS. 5 and 6 illustrate plan views of a coupling member without a foreign material blocking member, and a coupling member with a foreign material blocking member, respectively. FIG. 5 illustrates a plan view of a coupling member 510 when an actuator 511 is closed. The actuator 511 may be hingedly attached to the coupling member 510, in a manner similar to actuator 311 in FIGS. 3-4. The actuator 522 may removably fix a signal transmission member to the fixed coupler 512 on the coupling member 510. Regardless of whether the signal transmission member is coupled to the coupling member 510, a pin coupling portion 513 of the coupling member 510 may be partially exposed.

In a conventional plasma display device, silicone or the like may be coated on a predetermined portion, i.e., sealant area 520, of the coupling member 510 in order to prevent contamination by a foreign material. However, this practice produces some problems, e.g., an increase of production lead time, a destruction of an actuator due to the use of excessive silicone, and inconvenience of silicone removal for reapplication of silicone coating.

FIG. 6 illustrates a plan view of the coupling member 510 having a foreign material blocking member 530 attached thereto. The foreign material blocking member 530 may eliminate the need to coat a portion of the coupling member 510 with silicone. A shield 531 for the foreign material blocking member 530 may be equal to or larger than the pin coupling portion 513 of the coupling member 510 to prevent the intrusion of foreign material into the coupling member 510. The foreign material blocking member 530 may be made of a plastic, but the present invention is not limited to this material. FIG. 6 shows that predetermined portions of the foreign material blocking member 530 near the bosses may be removed to reduce material cost. However, the present invention is not limited to this removal. Further, the foreign material blocking member 530 is not limited to the "⊏"shape as illustrated in FIG. 6, but may be any shape necessary to prevent the intrusion of foreign material into the coupling member 510.

An actuator limiter 532 may be included in the foreign material blocking member 530 to prevent excessive rotation of the actuator 511.

FIG. 7 illustrates a perspective view of an interface between the coupling member and a block member 730. An actuator limiter 712 may be formed from the inside surface of a shield 731 of the foreign material blocking member 730. The actuator 705 may be thin to conform closely to the foreign material blocking member 730 and may enable the actuator 705 to rotate open a desired amount. Between a horizontal, closed position and a maximally opened position, the actuator 705 may rotate about 105 degrees, in an exemplary embodiment. Accordingly, a length "d" of the actuator limiter 712 may be just large enough to prevent the actuator 705 from being opened beyond the desired angle.

In FIG. 7, bosses 711 for fixing the foreign material blocking member 730 to a circuit board (not shown) are illustrated. The bosses 711 may be mounted through holes in the circuit board on which there may be no copper layers. Of course, the holes in the circuit board may be surrounded with a copper layer. However, the copper layers may be omitted when the foreign material blocking member 730 may be formed of plastic or when the foreign material blocking member 730 does not need to be grounded. The bosses 711 may be shaped so that center portions thereof may be partially removed and the outer circumferences of ends thereof increase inward, so that the bosses 711 may be easily detachable from or attachable to the circuit unit. In other words, a vertical cross-section of each of the bosses 711 may have the shape of an arrowhead whose outer circumference increases from the bottom end towards the top end of the arrowhead. Since the centers of the ends of the bosses 711 may be partially removed, the ends of the bosses 711 may compress radially to easily pass through the holes of the circuit board and couple the bosses 711 to the circuit board. After the arrowhead-shaped ends of the bosses 711 pass through the holes, the arrowhead-shaped ends may catch on the circuit board, so that the bosses 711 may be fixed in position.

For convenience of processing, the bosses 711 may be formed of plastic. However, the present invention is not limited to this material. The bosses 711 may be formed of any of the other suitable material, e.g., metal. The shape of the bosses 711 is not limited to the shape illustrated in FIG. 7. The bosses 711 may have another suitable shape so that the bosses 711 may be coupled to a circuit board, e.g., screwing, riveting, or other coupling method.

Figure 8:
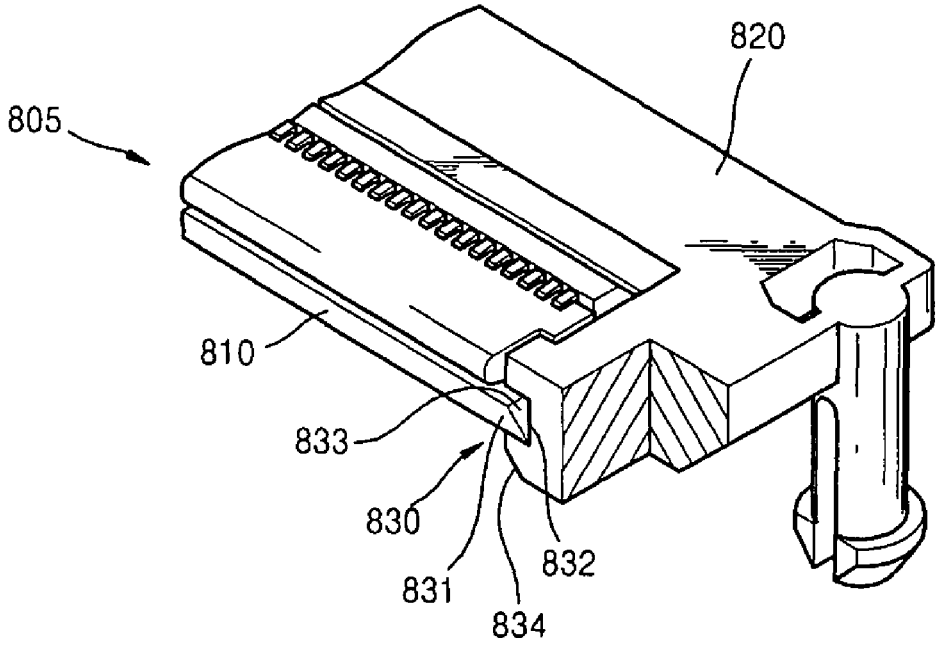
FIG. 8 illustrates a perspective view of a method of connecting a coupling member and a block member of a plasma display device according to another embodiment of the present invention.
Figure 9:
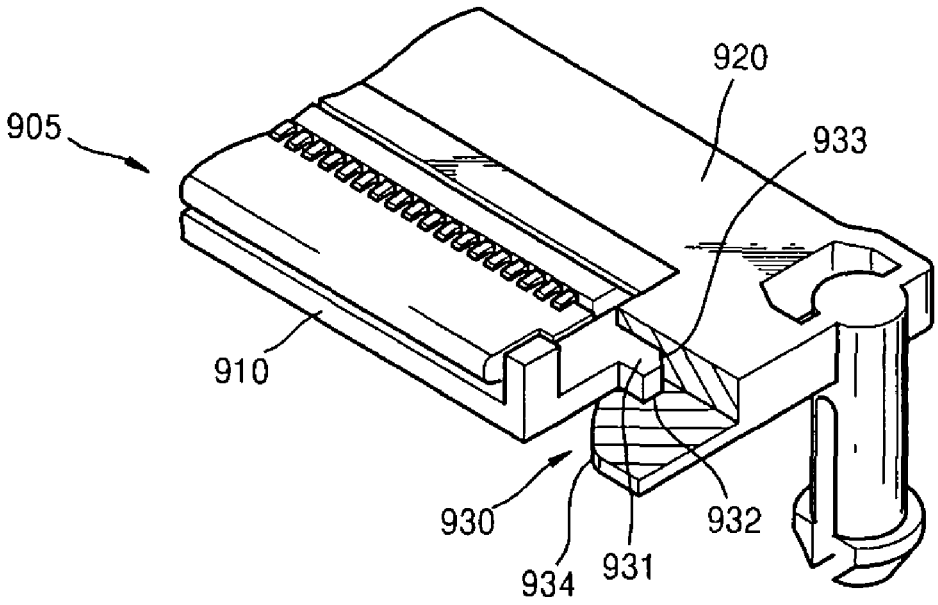
FIG. 9 illustrates a perspective view of a method of connecting a coupling member and a block member of a plasma display device according to another embodiment of the present invention.

A method of coupling a foreign material blocking member and a coupling member to each other will now be described in greater detail. FIGS. 8 and 9 illustrate a method for coupling a foreign material blocking member to a coupling member so that the two members adhere closely to each other.

FIG. 8 illustrates a perspective view of an interface between a coupling member 805 and a foreign material blocking member 830 of a plasma display device according to another embodiment of the present invention. As illustrated in FIG. 8, some bosses are cut away in order to facilitate understanding of the coupling method.

A foreign material blocking member 830 may include a shield 820, as described above. A coupling member 805 may attach into and engage the block 830. A protruding tab 831 may be formed on one end of a fixed part 810 of the coupling member 805. A groove 832 may be formed in the foreign material blocking member 830 so to provide an engagement position for the protruding tab 831. A first slanting surface 833 and a second slanting surface 834 may be formed on the fixed part 810 and the foreign material blocking member 830, respectively, opposite the coupling surface. The first slanting surface 833 and the second slanting surface 834 may be used as ramps to couple the foreign material blocking member 830 to the coupling member 805. The block 830 and the coupling member 805 may be snapped together using the first and second slanting surfaces 833 and 834.

The coupling relationship between the coupling member 805 and the foreign material blocking member 830 may be established at any interface between the block 830 and coupling member 805.

FIG. 9 illustrates a perspective view of an interface between a coupling member 905 and a foreign material blocking member 930 of a plasma display device according to still another embodiment of the present invention. As illustrated in FIG. 9, some bosses are cut away in order to facilitate understanding of the coupling method.

As described above, a foreign material blocking member 930 may include a shield 920. A coupling member 905 may attach into and engage the block 930. A protruding tab 931 may be formed on one end of a fixed part 910 of the coupling member 905. A groove 932 may be formed in the foreign material blocking member 930 so as to provide an engagement position for the protruding tab 931. However, in contrast with the embodiment of FIG. 8, a coupling surface where the protruding tab 931 and the groove 932 meet may be vertically oriented. A first slanting surface 933 and a second slanting surface 934 may be formed on the fixed part 910 and the foreign material blocking member 930, respectively. In the embodiment of FIG. 9, the foreign material blocking member 930 may be coupled to the coupling member 905 by sliding them together in a parallel and planar relationship so that the slanting surfaces 933 and 934 may engage each other. Of course, the foreign material blocking member 930 may also be coupled to the coupling member 905 by pressing the coupling member 905 down into the block 930. The coupling relationship between the coupling member 905 and the foreign material blocking member 930 may be established at any interface between the coupling member 905 the block 930.

A plasma display device according to the present invention may include a foreign material blocking member which may prevent foreign material from penetrating into a coupling member between a signal transmission member and a circuit unit. Thus, production lead time may be reduced as compared to when silicone may be used as a block against foreign material. The device may also reduce the risk of damage to the coupling member during the manufacture of the plasma display device. In addition, the foreign material blocking member may be easily removed from the circuit unit when a coupling member needs to be remounted.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display device, comprising:

a plasma display panel;

a chassis on one side of the plasma display panel and supporting the plasma display panel;

a plurality of circuit units on one surface of the chassis and generating electrical signals to drive the plasma display panel;

a signal transmission member connecting the circuit units to each other and to the plasma display panel so as to transmit the electrical signals;

a coupling member on at least one of the circuit units and coupling the signal transmission member to at least one of the circuit units; and a foreign material blocking member on the at least one of the circuit units protecting the coupling member from a foreign material, the foreign material blocking member including a plurality of mounting bosses, each mounting boss of the foreign material blocking member including a relief slot to enable quick attachment to and removal from the circuit unit.

2. The plasma display device as claimed in claim 1, wherein the signal transmission member is a FFC (flexible flat cable) or a TCP (tape carrier package).

3. The plasma display device as claimed in claim 1, wherein an end of each of the bosses includes a member having a vertical cross-section in the shape of an arrowhead whose outer circumference increases from a bottom end towards a top end of the arrowhead.

4. The plasma display device as claimed in claim 1, wherein the foreign material blocking member comprises a shield that encloses an exposed pin coupling portion of the coupling member.

5. A plasma display device, comprising:

a plasma display panel;

a chassis on one side of the plasma display panel and supporting the plasma display panel;

a plurality of circuit units on one surface of the chassis and generating electrical signals to drive the plasma display panel;

a signal transmission member connecting the circuit units to each other and to the plasma display panel so as to transmit the electrical signals;

a coupling member on at least one of the circuit units and coupling the signal transmission member to at least one of the circuit units; and a foreign material blocking member on the at least one of the circuit units protecting the coupling member from a foreign material, the at least one of the circuit units including a hole through which at least one boss of the foreign material blocking member is coupled to the at least one of the circuit units.

6. The plasma display device as claimed in claim 5, wherein the signal transmission member is a FFC (flexible flat cable) or a TCP (tape carrier package).

7. The plasma display device as claimed in claim 5, wherein the foreign material blocking member includes a shield that encloses an exposed pin coupling portion of the coupling member.

8. A plasma display device, comprising:

a plasma display panel;

a chassis on one side of the plasma display panel and supporting the plasma display panel;

a plurality of circuit units on one surface of the chassis and generating electrical signals to drive the plasma display panel;

a signal transmission member connecting the circuit units to each other and to the plasma display panel so as to transmit the electrical signals;

a coupling member on at least one of the circuit units and coupling the signal transmission member to at least one of the circuit units, wherein the coupling member includes a fixed coupler fixed to the circuit unit and an actuator rotatably attached to the coupling member, whereby the signal transmission member is coupled to the coupling member; and a foreign material blocking member on the at least one of the circuit units protecting the coupling member from a foreign material.

9. The plasma display device as claimed in claim 8, wherein the foreign material blocking member comprises an actuator limiter that limits rotation of the actuator.

10. The plasma display device as claimed in claim 9, wherein the actuator limiter defines a rotation range for the actuator.

11. The plasma display device as claimed in claim 8, wherein:

the fixed coupler includes a protruding tab, and the foreign material blocking member includes a groove, wherein the protruding tab engages the groove when the fixed coupler and the block are fully engaged.

12. The plasma display device as claimed in claim 11, wherein the protruding tab is formed on at least one of a pair of side surfaces and a rear surface of the fixed coupler, and the groove on the foreign material blocking member is disposed to engage the protruding tab.

13. The plasma display device as claimed in claim 11, further comprising:

a horizontal coupling surface integral with the foreign material blocking member; and slanted engagement ramps disposed on the foreign material blocking member and the fixed coupler perpendicular to the horizontal coupling surface.

14. The plasma display device as claimed in claim 11, further comprising:

a vertical coupling surface integral with the foreign material blocking member; and slanted engagement ramps disposed on the foreign material blocking member and the fixed coupler perpendicular to the vertical coupling surface.

15. The plasma display device as claimed in claim 8, wherein the signal transmission member is a FFC (flexible flat cable) or a TCP (tape carrier package).

16. The plasma display device as claimed in claim 8, wherein the foreign material blocking member includes a shield that encloses an exposed pin coupling portion of the coupling member.

* * * * *